United States Patent [19]

Morrow, Sr. et al.

[11] 3,988,008

[45] Oct. 26, 1976

[54] POWER LOWERING SYSTEM

[75] Inventors: James G. Morrow, Sr.; David J. Pech, both of Manitowoc, Wis.

[73] Assignee: The Manitowoc Company, Inc., Manitowoc, Wis.

[22] Filed: Oct. 23, 1975

[21] Appl. No.: 625,109

[52] U.S. Cl. ..... 254/183; 254/150 FH

[51] Int. Cl.[2] ..... B66D 1/50

[58] Field of Search ..... 254/150 H, 173 R, 183; 60/905

[56] References Cited

UNITED STATES PATENTS

| | | | |
|---|---|---|---|
| 2,232,317 | 2/1941 | Douglas | 60/905 X |
| 3,819,156 | 6/1974 | Sieracki | 254/173 R |
| 3,895,779 | 7/1975 | Casset et al. | 254/150 FH |

*Primary Examiner*—Robert J. Spar
*Assistant Examiner*—Fred A. Silverberg
*Attorney, Agent, or Firm*—Leydig, Voit, Osann, Mayer & Holt, Ltd.

[57] ABSTRACT

A power lowering system for a hoist drum including a hydraulic motor for rotating the drum in a lowering direction and hydraulic feedback means connected to a modulated torque converter for automatically applying opposing torque to the drum when heavy loads are lowered. A variable displacement pump supplies hydraulic fluid to the motor so that the load is lowered at a rate determined by the displacement of fluid supplied to the motor. A flow restriction is provided in the feedback means to the torque converter actuator to dampen cyclical variations in the application of opposing torque. Multiple hoist drums may be automatically clutched to the hydraulic motor and torque converter when separate manual control levers are initially moved in either the hoisting or lowering direction and an automatic brake release may also be employed.

12 Claims, 1 Drawing Figure

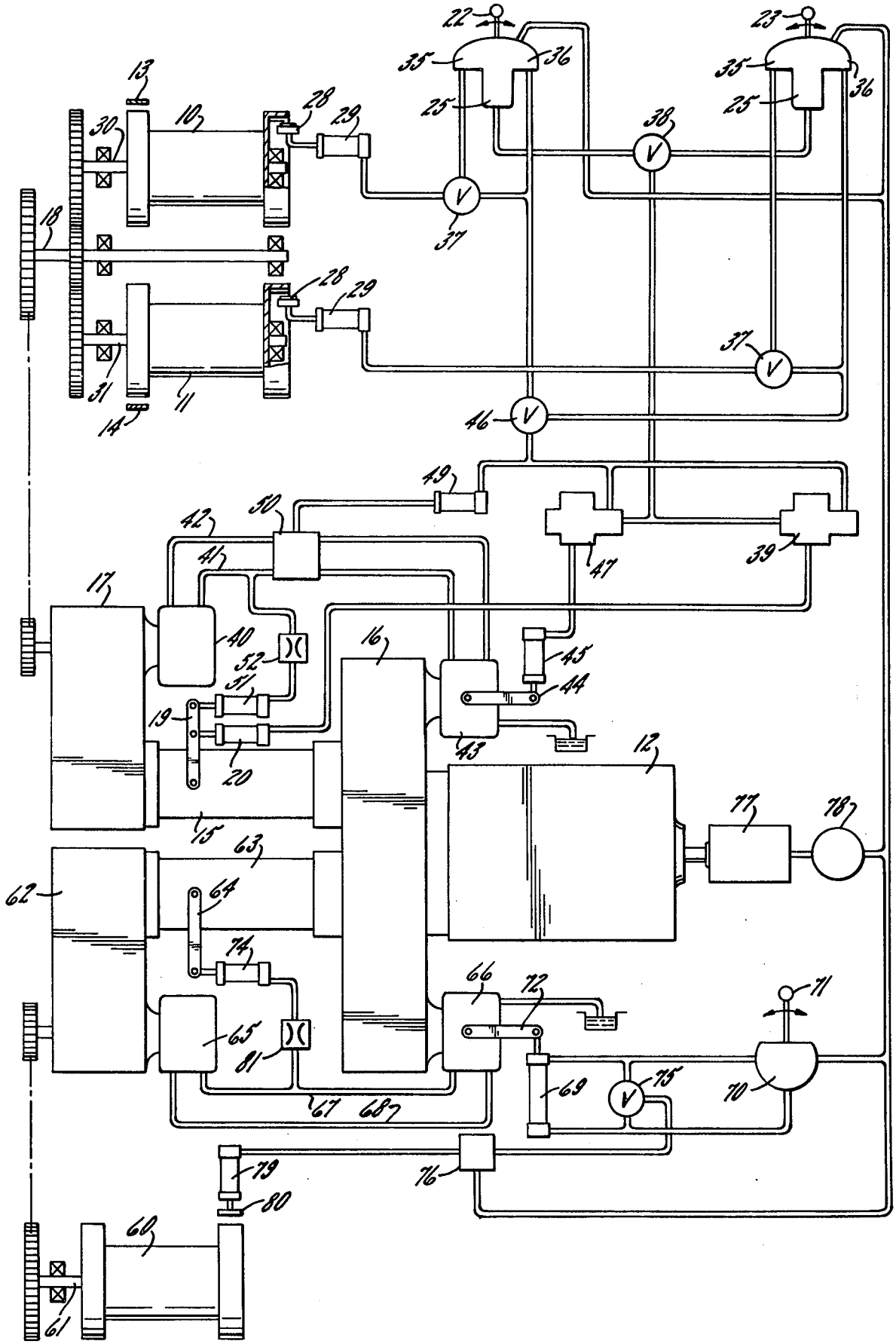
22
23
35
36
25
38
37
13
10
28
29
30
18
31
11
14
46
49
50
42
41
47
39
17
40
52
51
16
45
44
19
20
43
12
77
78
15
63
62
64
74
66
72
71
65
81
69
75
70
67
68
79
76
80
60
61

POWER LOWERING SYSTEM

The present invention relates generally to hoist drums for load lifting machinery and more particularly concerns a power lowering system for such hoist drums.

Load lifting devices such as cranes utilize cable, often rigged as multi-part line, for positioning booms and for lifting and lowering a load relative to a boom with the cable being payed out or taken in on powered hoist drums. Conventionally, such hoist drums are selectively clutched to a source of power which, preferably, can be controlled in the lifting direction to deliver variable torque to the hoist drum for speed and load flexibility. Also drum brakes are normally provided to lock the drums so as to hold the cable when the load is suspended and to control drum rotation when cable is payed out lowering the load.

More recently hydraulic motors have been coupled to the hoist drums to drive the drums in a direction to pay out cable and thus power lower the hook and/or load. One such system is disclosed in Sieracki U.S. Pat. No. 3,819,156 which issued June 25, 1974 to the assignee of the present application. As disclosed in the abovementioned patent, such lowering motors are small and if heavy loads are involved the motor is overrun requiring the operator to move the control lever bringing the main torque converter into play applying torque opposing rotation of the drum so that cable pay out can then be selectively slowed, stopped or even reversed. If the lowering motor is slowed or stalled under these conditions, the driving hydraulic fluid is simply returned to the reservoir through a relief valve.

The primary aim of the present invention is to provide an improved power lowering system in which the lowering rate is variable and controlled by the lowering motor with the main torque converter being brought into play automatically to maintain the selected lowering rate when heavy loads are involved.

A more detailed object is to utilize the feedback pressure from the lowering motor to modulate the operation of the main torque converter during lowering of heavy loads. It is also a more specific object to provide damping means in the feedback system to reduce "hunting" in the automatic application of the torque converter during lowering operation.

These and other objects and advantages of the invention will become more readily apparent upon reading the following detailed description and upon reference to the accompanying drawing, in which:

FIG. 1 is a schematic of a control system embodying the present invention.

While the invention will be described in connection with certain preferred embodiments, it should be understood that we do not intend to limit the invention to such embodiments. On the contrary, we intend to cover all alternatives, modifications and equivalents as may be included within the spirit and scope of the invention as defined by the appended claims.

Turning now to FIG. 1, there is schematically shown a pair of front and rear cable hoist drums 10 and 11 suitable for use in a lift crane and adapted to be driven, from an engine 12 supplying a source of torque, under the control of a system embodying the present invention. The drums 10, 11 are held normally locked by band brakes 13 and 14, respectively, engaging a cylindrical portion of each drum. Preferably, the brakes 13, 14 are self-tightening as the drums 10, 11 rotate in the direction to pay out cable and they may be released by mechanical and/or air actuated linkages (not shown) under control of the crane operator.

To drive the drums in a cable take-up direction a torque converter 15 is interposed between two transmission cases 16 and 17, one coupled to the engine 12 and the other to a main drum drive shaft 18. The converter 15 is preferably of the variable or modulated type shown in more detail in U.S. Pat. Nos. 3,221,896 and 3,335,568, issued Dec. 7, 1965 and Aug. 15, 1967, respectively, and includes a control lever 19 for regulating the torque output. Alternatively, if the converter is of a non-modulated type a modulated clutch may be employed on either the input or the output side of the converter. It will be understood by those skilled in the art that the engine 12 is normally run at constant speed during lifting operation and the torque applied to the drums 10, 11 is varied by modulating the torque converter 15 or by selectively engaging the modulated clutch (not shown). The control lever 19 is normally biased to the blocked or off position by a spring which is opposed by a pneumatic actuator 20. By modulating the air pressure to the actuator 20, the control lever 19 can be variably positioned and the torque transmitted by the converter 15 precisely adjusted.

Each of the drums 10, 11 is associated with a respective control device in the form of a manually positionable lever 22 or 23 each operating a throttling valve 25 for modulating the air pressure to the actuator 20. So that a single converter 15 can selectively power the two drums 10 and 11, clutches 28 are interposed between the drums 10, 11 and drum shafts 30 and 31 which are coupled to the main shaft 18 through appropriate gearing. The clutches 28 are operated by pneumatic actuators 29 supplied with air from dual open and shut sections 35 and 36 of the valves 25 under control of the levers 22 or 23. Thus, to take up cable on either hoist drums 10 or 11, the operator pulls the respective control lever 22, 23 back (counterclockwise as seen in FIG. 1). Air under pressure goes from valve section 35 through a shuttle valve 37 to actuator 29 engaging the clutch 28 on the respective drum 10, 11. Further rearward movement of the control lever 22 opens the modulated valve section 25 directing pressurized air through a shuttle valve 38 and a normally open directional valve 39 to the converter control actuator 20, gradually increasing the force through the actuator 20 to move the control lever 19 and thus impose increasing torque from the converter 15 onto the associated drum. When the torque exceeds the torque load on the cable, the drum will begin to rotate in the cable take-up direction. The brake 13 or 14 is released and, thereafter, the speed of the lift is dependent upon the position of the respective lever 22, 23.

In accordance with the present invention, to pay out cable and thus lower a load, a hydraulic motor 40 is coupled (through the clutches 28) to the drums 10, 11 on the output side of the converter 15. Fluid under pressure is supplied to the motor 40 through first and second supply-return lines 41, 42 from a variable pump 43 driven by the engine 12. The pump 43 includes a control lever 44 normally biased by a spring (not shown) to the zero displacement position. Opposing the bias on the lever 44 is a pneumatic actuator 45 which, when pressurized, progressively shifts the lever to full forward displacement.

When the operator pushes one of the levers 22, 23 forward (clockwise in FIG. 1) air from section 36 goes through shuttle valve 37 to the respective clutch actuator 29. Air from section 36 also goes through shuttle valve 46, closes normally open valve 39, opens normally closed valve 47 and operates an actuator 49 closing a diverter valve 50 so as to place the pump 43 in communication with the motor 40 through the supply-return lines 41, 42. Further forward movement of the lever 22 or 23 opens the modulating section 25 and air passes through shuttle valve 38 and directional valve 47 to the pump displacement control actuator 45.

If there is only a light load, or no load, on the cable, the motor 40 rotates the drum 10 or 11 to pay out cable at the lowering speed set by the variable displacement pump 43 in accordance with the position of the respective control handle 22, 23 and the amount of pressure supplied to the pump actuator 45. If a heavy load is suspended from the cable, the load generated torque on the drum 10 or 11 drives the motor 40 causing it to operate as a pump and thus pressurize supply-return line 41. When this back pressure reaches a predetermined level it operates a hydraulic actuator 51 opposing the normal spring force on the torque converter control lever 19. Torque is then delivered to the drum by the torque converter in a load lifting direction. This decreases the lowering torque imposed by the drum on the motor 40 and the back pressure in line 41 falls below the predetermined level. The heavy load is then lowered at the rate set by the displacement of the variable pump 43 in accordance with the position of the handle 22 or 23.

To keep the torque converter 15 from "hunting" or cycling back and forth during power lowering of heavy loads a restriction or control orifice 52 is preferably interposed in the line between the actuator 51 and the supply-return line 41. This dampens the flow to and from the actuator 51 and provides for smoother operation.

During hoisting with the drums 10 or 11, the diverter valve 50 is in its normally open position shunting the flow of hydraulic fluid around the motor 40, in this case a fixed displacement type motor. Thus the diverter valve 50 precludes the flow of hydraulic fluid from the motor to the pump when the motor is driven by the drum in a load lifting direction. The actuator 49, as mentioned above, shifts the diverter to its closed position thus disabling it (from shunting flow between lines 41, 42) during load lowering operation. It should also be appreciated, however, that a variable displacement motor could be used instead of the fixed displacement motor 40. In that case, a diverter valve 50 would not be necessary as the operating lever of the variable motor could be normally biased to zero displacement, precluding flow to the pump 40 when in that position, and opposed by the actuator 49 which would throw the motor control lever to full forward displacement.

In keeping with a further aspect of the present invention a single-lever, fully powered control system is provided for a boom hoist drum 60 of a lift crane or the like. The boom hoist drum 60 is fixed to a shaft 61 driven through appropriate gearing from a transmission case 62 coupled to a torque converter 63 driven from a second output of the transmission 16. Preferably the torque converter 63 is of the modulated type having a control lever 64 biased to the "off" position. Alternatively, a modulated clutch may be interposed between the torque converter and the drum 60.

A hydraulic motor 65 is also coupled to the transmission 62 for the boom hoist drum 60. The motor 65 is driven by a reversible variable displacement pump 66 through reversible supply-discharge lines 67 and 68.

Regulation of the pump 66 is accomplished through a double acting pneumatic actuator 69 under control of a modulated valve 70 operated by a manual control lever 71. When the lever 71 is pulled back (counterclockwise in FIG. 1) the actuator 69 is pressurized moving a control lever 72 on the pump to a position pressurizing line 67 and driving the motor 65 in a boom hoisting direction. If the boom is heavy, the back pressure in supply-discharge line 67 builds up and when a predetermined pressure is reached an actuator 74 connected to the torque converter control lever 64 is operated. Additional torque is now delivered to the drum 60 from the torque converter 63 and the drum is rotated in the direction to hoist the boom.

When the valve 70 is opened air pressure is also directed through a shuttle valve 75 to open a relay 76 directing air pressure from an engine driven pump 77 and reservoir 78 to an actuator 79 releasing a brake 80 normally biased into engagement with a cylindrical portion of the boom hoist drum 60.

To lower the boom, cable is payed out from the boom hoist drum. The operator moves the control lever 71 forward (clockwise in FIG. 1) causing the actuator 69 to move the pump lever 72 into the reverse displacement position. This pressurizes line 68 and drives the motor 65 in the direction to pay out cable. If the boom and its suspended load is heavy the motor 65 operates as a pump creating back pressure in line 67. When this pressure reaches a predetermined level, the actuator 74 is energized bringing the torque converter 63 into play. A control orifice or restriction 81 between the actuator 74 and supply-return line 67 prevents excessive "hunting" of the torque converter 63 during powered boom lowering.

From the foregoing, it will be appreciated that a power lowering system is provided for the main hoist or boom hoist drums of a lift crane that automatically energizes the lift drum hoist converter when the back pressure in the hydraulic lowering motor exceeds a predetermined level. The system also provides for automatically clutching multiple main hoist drums to the main hoist torque converter upon operation of each hoist drum manual control lever in either the lifting or lowering direction. Moreover, means are also provided for automatically releasing the brake on the boom hoist drum when it is operated in either direction. The system further provides for a controlled orifice or restriction in the feedback from the power lowering pump to the torque converter actuator to prevent "hunting" of the torque converter during lowering of heavy loads by the respective hoist drums 10, 11 and 60.

We claim as our invention:

1. A power lowering system for a hoist drum of a load lifting device having an engine and a torque converter for rotating the drum in a load lifting direction comprising in combination, means for selectively controlling the torque delivered to the drum by the converter, a hydraulic motor connected to the drum, a variable displacement pump driven by the engine and having first and second supply-return lines connected to the motor, means for regulating the displacement of the pump to drive the motor in a load lowering direction and feedback means including an actuator interposed between the first supply-return line and the selective control means for delivering torque from the converter to the drum when the load being lowered causes the pressure in the first supply-return line to reach a predetermined level.

2. A power lowering system as defined in claim 1 wherein the torque converter includes a movable control lever for modulating the torque delivered to the drum and the actuator includes a hydraulic piston-cylinder combination with the piston connected to the lever and the cylinder in communication with the first supply-return line.

3. A power lowering system as defined in claim 1 wherein the selective control means includes a modulated clutch with a movable control element interposed between the converter and the drum and the actuator includes a hydraulic piston-cylinder combination with the piston connected to the control element and the cylinder in communication with the first supply-return line.

4. A power lowering system as defined in claim 1 including means for precluding the flow of hydraulic fluid from the motor to the pump when the motor is driven by the drum in a load lifting direction, and means for disabling the precluding means placing the pump in operative communication with the motor when the pump is regulated to drive the motor in a load lowering direction.

5. A power lowering system as defined in claim 4 wherein the motor is a fixed displacement type and the precluding means includes a normally open diverter valve interposed between the supply and return lines for shunting the flow of hydraulic fluid around the motor.

6. A power lowering system as defined in claim 5 wherein the disabling means includes a second actuator for closing the normally open diverter valve.

7. A power lowering system as defined in claim 4 wherein the motor is of the variable displacement type, the precluding means is operative to place the motor in zero displacement condition, and the disabling means includes a second actuator for shifting the motor into forward displacement condition.

8. A power lowering system as defined in claim 1 wherein the feedback means includes a flow restriction between the first supply-return line and the actuator to dampen cyclical variations in the operation of the selective control means.

9. A power lowering system as defined in claim 1 including means for reversing the flow through said first and second supply-return lines to drive the motor in a load lifting direction and said feedback means operates the selective control means for delivering torque from the converter to the drum when the load being lifted causes the pressure in the first supply-return line to reach a predetermined level.

10. A power lowering system as defined in claim 1 including a source of air pressure, an air cylinder for regulating the displacement of the pump and a manually operated valve for selectively modulating the air pressure delivered to the air cylinder.

11. A power lowering system as defined in claim 10 wherein the drum is provided with a brake band normally biased into engagement with the drum, and means including a second air cylinder are provided for disengaging the brake band when said valve is manually operated.

12. A power lowering system as defined in claim 1 including first and second hoist drums selectively clutched to the torque converter, a source of air pressure, a first air cylinder for regulating the displacement of the pump, second and third air cylinders for respectively actuating the clutches for the first and second hoist drums, and means including first and second manually operated valves for selectively modulating the air pressure delivered to the first air cylinder and for respectively pressurizing said second and third air cylinders.

* * * * *